United States Patent [19]

Fey

[11] Patent Number: 4,466,044

[45] Date of Patent: Aug. 14, 1984

[54] CENTRAL LOCKING SYSTEM

[75] Inventor: Rainer Fey, Schweinfurt, Fed. Rep. of Germany

[73] Assignee: Fichtel & Sachs AG, Schweinfurt, Fed. Rep. of Germany

[21] Appl. No.: 463,557

[22] Filed: Feb. 3, 1983

[30] Foreign Application Priority Data

Feb. 13, 1982 [DE] Fed. Rep. of Germany ..... 3205167

[51] Int. Cl.[3] ..... H01H 47/22

[52] U.S. Cl. ..... 361/152; 361/172; 361/191; 307/10 AT; 70/264; 70/237

[58] Field of Search ..... 361/152, 191, 192, 193, 361/171, 172, 156; 307/10 R, 10 AT; 70/264, 237

[56] References Cited

U.S. PATENT DOCUMENTS 4,424,548 1/1984 Fey et al. ..... 361/156 X

FOREIGN PATENT DOCUMENTS 2757246 12/1977 Fed. Rep. of Germany .
2730387 1/1979 Fed. Rep. of Germany ..... 70/264
3008964 3/1980 Fed. Rep. of Germany .
2081800 2/1982 United Kingdom ..... 70/264

*Primary Examiner*—Reinhard J. Eisenzopf
*Attorney, Agent, or Firm*—Toren, McGeady and Stanger

[57] ABSTRACT

The central locking system adapted especially to motor vehicles comprises a plurality of electric locking drives and a time control circuit triggerable by at least one control switch in switching over from a first switch position to a second switch position. The time control circuit switches on the locking drives for a predetermined time duration in a predetermined drive direction. A switch signal generator controlled by the control switch generates a first two-level control signal the control levels of which represent the switch positions of the control switch. The switch signal generator in the switching over of the control switch from the first switch position into the second switch position triggers a ramp signal generator which delivers a ramp signal varying in time with constant direction from a predetermined initial level. A comparator, especially a differential amplifier or an operational amplifier, compares the level of the ramp signal with the constant reference signal level of a reference signal generator and generates a second two-level control signal, the control level of which represents the sign of the level difference of the ramp signal and the reference signal. A control stage switches on the locking drives in the predetermined drive direction as long as the first control signal occurs with the control level representing the second switch position of the control switch and at the same time the second control signal occurs with the control level resulting for the predetermined initial level of the ramp signal, the control stage furthermore switching off the locking drives for the predetermined drive direction.

23 Claims, 8 Drawing Figures

CENTRAL LOCKING SYSTEM

BACKGROUND OF THE INVENTION

The invention relates to central locking systems, especially for motor vehicles, and more particularly to a central locking system comprising a plurality of electric locking drives, a time control circuit means triggerable by at least one control switch in switching over from a first switch position into a second switch position, said circuit means switching on the locking drives for a specific time duration in a predetermined drive direction.

Central locking systems of this kind are known, for example from German publication specification No. 27 57 246. The locking drives are controlled by a timed current pulse, which is triggered by means of a control switch and so timed that the locking drives are switched on for a time period adequate either for locking or for unlocking. It has appeared that the duration of the drive pulse of known central locking systems cannot be kept sufficiently constant under the operating conditions in a motor vehicle. In the motor vehicle the time control circuit can be subjected to temperature fluctuations, for example between −40° C. and +80° C., while in addition the supply voltage can fluctuate between 9 and 15 volts. The influence of these operational conditions can lead to short and inadequate drive pulses, by which the locks are not locked or not unlocked, or excessively long drive pulses can result which can lead to damage to the locking drives or the locks.

The invention is directed towards improving the above-explained central locking system in a constructionally simple manner so that the drive pulses fed to the locking drives can be kept sufficiently constant even under greatly fluctuating operational conditions, especially as regards the ambient temperature and the supply voltage.

SUMMARY OF THE INVENTION

Briefly, the present invention may be described as a central locking system, particularly suitable for motor vehicles comprising a plurality of electric locking drives and a time control circuit means triggerable by at least one control switch in switching over from a first switch position into a second switch position. The time control circuit means switches the locking drives on for a predetermined time duration in a predetermined drive direction. A switch signal generating means which is controlled by the control switch generates a first two-level control signal. The control levels of the first control signal represent the switch positions of the control switch. A ramp signal generator means which generates a ramp signal varying in time from a predetermined initial level with constant direction is triggered by the switch signal generating means when the control switch is switched over from its first switch position into its second switch position. A comparator means compares the level of the ramp signal with a constant level of a reference signal and generates a second two-level control signal the control level of which represents the sign of the level difference between the ramp signal and the reference signal. A control means switches on the locking drives in the predetermined drive direction as long as the first control signal occurs with a control level representing the second switch position of the control switch and at the same time the second control signal occurs with a control level resulting for the predetermined initial level of the ramp signal. Otherwise, the control means switches off the locking drives for the predetermined drive direction.

The ramp signal and the reference signal are derived from the same operating voltage source, so that fluctuations of operating voltage take effect in the same direction upon both signals and can be compensated by difference formation. The comparator means is therefore formed preferably as difference amplifier, especially operation amplifier with high input resistance and high amplification. Schmitt-Trigger stages can likewise be used provided that additional stabilising measures are taken for the reference voltage. Such measures can be omitted if differential amplifiers are used.

The switch signal generator means and the comparator means each generate two-level control signals which, linked with one another similarly to a logic circuit, determine the time duration of the drive pulse delivered to the locking drives. The switch level of the control signal delivered by the switch signal generator means varies in the switching of the control switch and determines the leading edge of the drive pulse, while the control signal of the comparator means determines the trailing edge of the drive pulse.

The control means can be a gate circuit which is assembled using logic gates, for example an AND-gate. However in a preferred embodiment a switch transistor will be used which at the same time can be utilised as driver stage for example for a relay switching the drive current of the locking drives. In this embodiment the collector current of the switch transistor controls the locking drives directly or indirectly through a relay. The base of the switch transistor is in this case connected to the control signal output of the comparator means, while the collector-emitter path is connected in series with the control switch. The control signals of the switch signal generator means and of the comparator means are dimensioned so that the requisite base and emitter potentials for the switch operation of the switch transistor result. In a simple embodiment this can be achieved in that the control switch is connected between ground and the emitter of the switch transistor, the emitter being connected through a resistor with a circuit point which conducts a potential blocking the switch transistor when the control switch is opened.

The ramp signal generator can be an integrator which integrates a constant input voltage to provide a ramp signal rising or falling linearly in time. Such integrators however frequently comprise an integration amplifier which increases the expense for components. Such an amplifier becomes superfluous in an embodiment in which the ramp signal generator comprises a first circuit connected to a capacitor, which independently of the switch position of the control switch permits current to flow in a first current direction through the capacitor and in which the control switch is connected to a second circuit which, in one of the switch positions of the control switch, permits current to flow through the capacitor in a second current direction opposite to the first current direction. The comparator means is connected to the capacitor and monitors the capacitor potential. The switch signal generator means especially can be utilised also as second circuit if the control levels of its control signal are suitably dimensioned.

In a first preferred embodiment of such a ramp signal generator the capacitor is charged up to a predetermined voltage, especially the operating voltage, in the first switch position of the control switch, that is during the rest time in which the locking drives are switched off. The first circuit thus forms a charging circuit for the capacitor, which is overdriven in the switching over of the control switch into the second switch position, by connection of the discharge circuit. The discharge time constant of the second circuit is in this case made shorter than the charging time constant of the first circuit.

Alternatively in a second embodiment the first circuit can be formed as discharge current circuit which discharges the capacitor when the locking drives are switched off. The second circuit forms a charging circuit by way of which the capacitor is charged up in the second switch position of the control switch. The charging time constant of the second circuit must here be shorter than the discharge time constant of the first circuit.

The time duration of the drive pulses can be kept constant in an especially wide range of fluctuation of the operating parameters, if in the first-mentioned embodiment, in which the capacitor is discharged during the duration of the drive pulse, the reference voltage is approximately equal to one-third of the available rated operating voltage. In the second embodiment in which the capacitor is charged during the switch-on duration of the locking drives, the reference voltage preferably amounts to about two-thirds of the rated operating voltage.

A further improvement, which can also be used in other central locking systems of the kind as explained in greater detail initially, where the control switch is closed in its second switch position, consists in that with the control switch there is connected in parallel the collector-emitter path of a switch transistor controlled by the time control circuit means. This switch transistor short-circuits the control switch during the predetermined time duration in which the locking drives are switched on. The switch transistor ensures that the time control circuit means can be triggered reliably independently of any voltage drops which can occur in the supply lead between the control switch and the time control circuit means. The switch transistor which short-circuits the control switch can be controlled directly by the output signal of the time control means. The simplest way of achieving a defined switching behaviour of this switch transistor consists in coupling its base on the motor side to a pole-reversing circuit controlled by the time control means, since motor-side circuit points of the pole-reversing circuit lie either at ground potential or at operating voltage potential, in dependence upon the desired drive direction.

The above-explained embodiments of the time control circuit means are used in locking drives operable in two opposite drive directions, which are connected in parallel to a pole-reversing circuit controlled by relays, in a manner in which at least one separate time control circuit is provided for each drive direction. The control switches are here formed as control changeover switches which trigger the time control circuits alternately. In the embodiments of the time control circuits as explained above the relay current flows through the control changeover switches, so that only the time control circuits for one of the two directions of drive are ever switched on. This measure increases operational reliability.

In some operating situations the control switch will initially be set to unlocking, in order then to be switched over briefly thereafter to locking. In order to exclude faults in operation, in embodiments where a switch transistor is connected in series with the control switch, it is provided that the base of the switch transistor which switches on the locking drives in the unlocking direction is coupled through a diode with the collector of the switch transistor which switches on the locking drives in the locking direction. The diode ensures that on switching on in the locking direction the switch transistor of the unlocking direction is positively controlled into its open condition in which the unlocking direction is blocked.

Control changeover switches which are positively manually switched over together with the associated lock, as for example the locks of the front doors, are ordinarily associated with the locking drives of the central locking system. Other locks, for example the boot lock, should be capable of being locked independently of the locking conditions of the central locking system. The control changeover switches are additionally positively switchable by the locking drives in order to achieve a synchronous opening or locking movement. In order that even in the case of a boot lock which is lockable independently of the door locks, operating faults in the actuation of the control changeover switch of the boot lock may be reliably excluded, it can be provided that the control changeover switch of this lock triggers at least one additional time control circuit means which switches on the locking drives. In this way the control changeover switch of the manually independently lockable lock is de-coupled from the locking condition of the other locks. In place of an additional time control circuit means the control changeover switch of this manually independently lockable lock can also be connected to a time member which delivers a pulse triggering the time control circuit means on switching over of the control changeover switch.

A further expedient feature consists in connecting the energising circuit of the relays controlling the locking drives and the time control circuits through separate diodes, polarised in the forward direction, to an operating voltage terminal. The diodes block the time control circuit means against interference pulses from the power circuit of the locking drives.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE PREFERRED EMBODIMENTS

Figure 1:
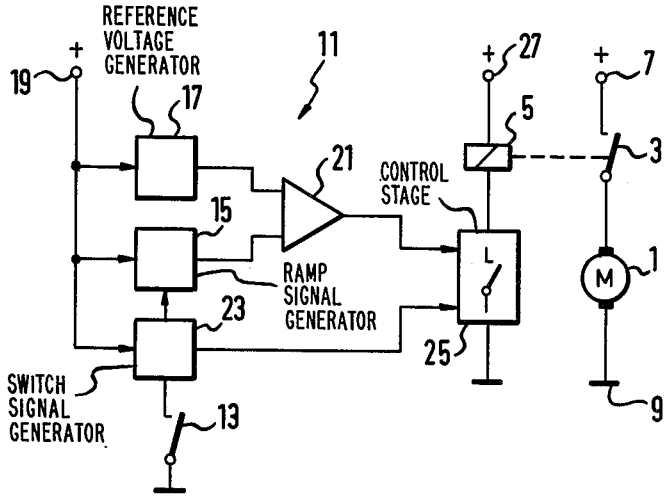
FIG. 1 a shows a circuit diagram of the principle of a time control circuit arrangement for a motor vehicle locking installation, where only the elements necessary for one drive direction are shown.

FIG. 1 shows an electric drive motor 1 of a locking drive for a motor vehicle central locking system which moves the bolt of a door lock, a boot lock of the like. The motor 1 can be a motor of reversible direction of rotation, as explained in greater detail hereinafter, or it can be a motor which can be switched on in only one single direction, provided that a second motor operated in corresponding manner is provided for the contrary movement. The motor 1 is connected in series with a relay contact 3 of a relay 5 between an operating voltage terminal 7 and ground 9. A time control circuit 11 which is triggered by actuation of a control switch 13 controls the energisation of the relay 5 in such manner that the relay contact 3 is closed for a predetermined time duration and the motor 1 is switched on for the predetermined time duration. Otherwise the relay contact 3 is opened.

The predetermined time duration is dimensioned so that the motor 1 can reliably lock or unlock the associated lock. In order to achieve the most uniform possible duration of switching on of the motor 1, largely independently of the operating temperature and the operating voltage, the time control circuit 11 comprises a ramp signal generator 15 which, starting from an initial voltage predetermined on actuation of the control changeover switch 13, delivers a voltage varying, for example increasing or decreasing, in the same direction. A reference voltage generator 17, which is connected together with the ramp signal generator 15 to a common operating voltage terminal 19, supplies a constant reference voltage. The ramp signal generator 15 and the reference voltage generator 17 are connected to the two inputs of a differential amplifier 21, which can be an operation amplifier with high amplification and high input resistance or a comparator. At the output of the differential amplifier 21 a two-level control signal is available the level of which changes when the ramp voltage, varying in time, of the ramp signal generator 15 exceeds the reference voltage of the reference voltage generator 17. The control switch 13 is connected to a switch signal generator 23 which likewise delivers a two-level control signal. The levels of this control signal represent the two switch positions of the control switch 13. The control signals of the differential amplifier 21 and of the switch signal generator 23 control a control stage 25 which is connected into the energising circuit of the relay 5 between an operating voltage terminal 27 and ground, and controls the energising current of the relay 5. The relay 5 is energised and thus the motor 1 is switched on when the switch signal delivered by the switch signal stage 23 has the switch level allocated to the drive direction of the motor 1 and at the same time the differential amplifier 21 has the switch level resulting at the predetermined initial voltage, that is to say before the reaching of the reference voltage level. In the case of other combinations of the switch levels of these control signals the energising current of the relay 5 remains switched off. The switch signal stage 23 furthermore controls the re-setting of the ramp signal generator 15 into the initial condition. The motors of all locking drives are connected in parallel with one another so that on actuation of the control switch 13 all the locking drives are switched on in common.

Figure 2:
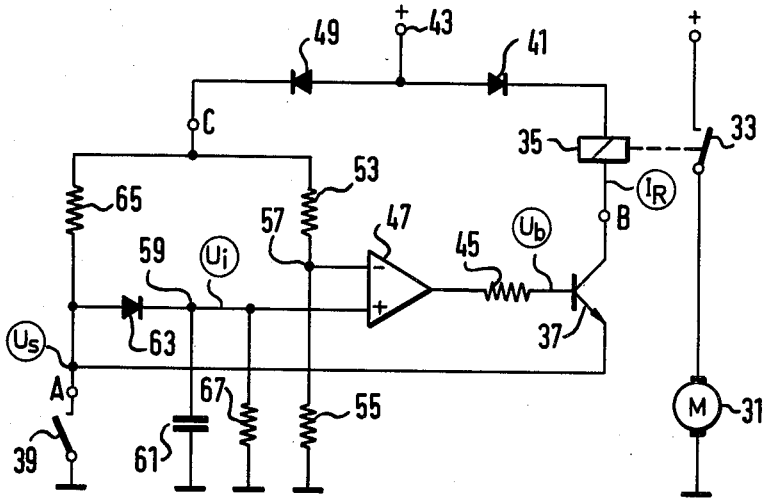
FIG. 2 shows a detailed circuit diagram of a first embodiment of the time control circuit arrangement according to FIG. 1.

FIG. 2 shows details of a first embodiment of the circuit arrangement according to FIG. 1. A motor 31, corresponding to the motor 1, of a locking drive, with which further motors (not shown) are connected in parallel, is switched on in a predetermined drive direction by means of a relay contact 33 of a relay 35. The energising current of the relay 35 is controlled by a switch transistor 37. The collector-emitter path of this switch transistor is connected in series with the energising winding of the relay 35 and a control switch 39 switching on the predetermined drive direction. The control switch 39 corresponds to the control switch 13 according to FIG. 1 and is connected to ground. The energising winding of the relay 35 is connected through a diode 41 polarised in the forward direction with a voltage supply terminal 43. The energising current of the relay 35 can flow when the control switch 39 is closed and the switch transistor 37 is switched through, i.e. is conducting.

The base of the switch transistor 37 is connected through a base series resistance 45 to a differential amplifier 47 corresponding to the differential amplifier 21 according to FIG. 1. The differential amplifier 47 works in saturation operation. Through a diode 49 likewise polarised in the forward direction a voltage divider circuit formed from resistors 55 and 53 is connected between ground and the operating voltage terminal 43. The voltage divider circuit forms a reference voltage source which delivers a reference voltage dependent upon the operating voltage at the junction point 57 of the resistors 53 and 55. The differential amplifier 47 is connected with its inverting input − to the junction point 57. The non-inverting input + of the differential amplifier 47 is connected to a terminal 59 of a capacitor 61 the other terminal of which is connected to ground. The terminal 59 is connected with the operating voltage terminal 43 by way of the diode 49 through a diode 63 polarised in the forward direction and a resistor 65 connected on the capacitor-remote side of the diode 63 in series to the diode 63. The junction point between the diode 63 and the resistor 65 is connected to the ground-remote terminal of the control switch 39 and/or the emitter of the switch transistor 37. The resistor 65 and the diode 63 form a charging circuit for the capacitor 61 by way of which the latter is charged up to the potential of the operating voltage terminal 43 when the control switch 39 is opened. Parallel with the capacitor 61 a discharge resistor 67 is connected. When the control switch 39 is closed the charging current circuit is decoupled from the capacitor 61 and the capacitor discharges itself with the discharge time constant determined by the resistor 67.

Figure 3:
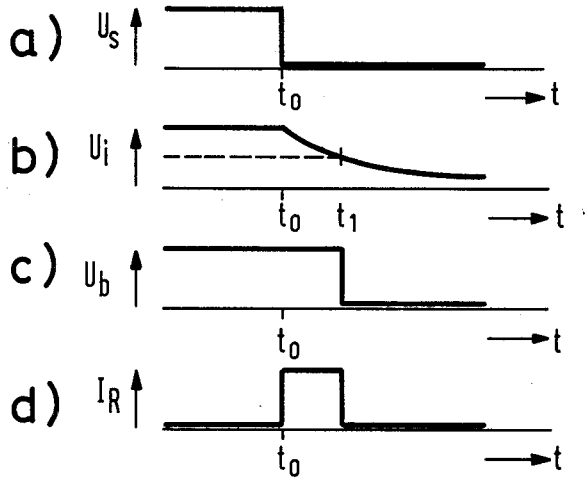
FIG. 3 shows time diagrams of a plurality of signals occurring at different circuit points of the circuit arrangement according to FIG. 2.

The circuit arrangement according to FIG. 2 works as follows:

In the rest condition the switch 39 is opened, so that the capacitor 61, as already mentioned, can charge itself up to the operating voltage through the resistor 65 and the diode 63. The reference voltage at the circuit point 57 amounts to about one-third of the operating voltage, so that the output voltage of the saturatable differential amplifier 47 likewise nearly reaches the operating voltage. The switch transistor 37 however cannot switch through, since its emitter, through the resistor 65, likewise lies at operating voltage potential. The relay 35 is not energised. This situation also appears from the time diagrams in FIGS. 3*a* to *d*, of which FIG. 3*a* shows the voltage $U_S$ at the terminal of the control switch 39 remote from ground and thus at the emitter of the switch transistor 37. In FIG. 3*b* there is represented the time course of the voltage at the terminal 59 remote from ground of the capacitor 61. FIG. 3*c* shows the time course of the voltage potential $U_b$ on the base of the switch transistor. In FIG. 3*d* there is illustrated the time course of the energising current $I_R$ of the relay 35.

On closing of the control switch 39 at the moment $t_0$ the emitter of the switch transistor 37 is connected with ground, which has the consequence that the switch transistor 37 switches through and the relay 35 is energised, since the base of the switch transistor 37 at this moment still lies as before at operating voltage potential (FIG. 3*c*). With the closing of the control switch 39 the junction point of the resistor 65 and of the diode 63 is at the same time connected with ground, whereby the charging current of the capacitor 61 is interrupted. The capacitor 61 discharges itself subsequently through the resistor 67. Direct discharging of the capacitor 61 through the control switch 39 is prevented by the diode 63, which is polarised in the blocking direction in relation to the charging of the capacitor 61. As soon as the reference voltage entered in chain lines in FIG. 3*b* is reached (moment $t_1$) the output level of the sum-and-difference amplifier 47 varies suddenly, whereby the base of the switch transistor 37 is switched to ground potential. The switch transistor 37 opens and interrupts the energising current of the relay 35.

The resistor 53 of the reference voltage source and the resistor 65 of the charging current circuit of the capacitor 61 are connected to a common circuit point C which is connected through the diode 49 with the operating voltage terminal 43. The charging voltage of the capacitor 61 and the reference voltage thus vary in the same direction. The diodes 41 and 49 suppress interference pulses which could couple themselves over from the power part of the relay circuit into the time determining circuits.

Figure 4:
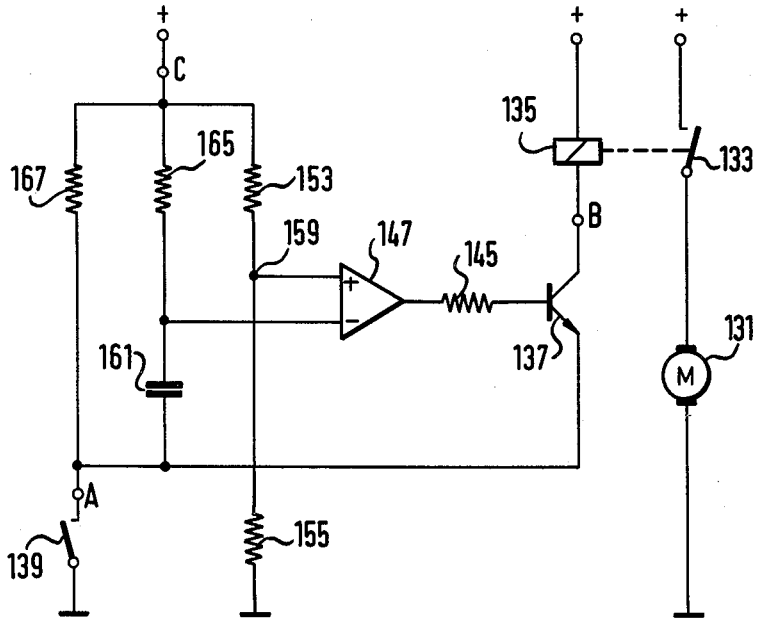
FIG. 4 shows a second embodiment of the time control circuit arrangement according to FIG. 1.

FIG. 4 shows another embodiment of a time control circuit arrangement in which parts having the same function as parts of the circuit arrangement according to FIG. 2 are designated by reference numerals increased by the number 100. To explain the circuit arrangement and manner of operation of the motor 131, of the relay contact 133, the relay 135, the switch transistor 137, the control switch 139, the base series resistance 145, the differential amplifier 147, the voltage divider consisting of resistors 153, 155 and supplying a reference voltage, therefore reference is made to the description of the circuit arrangement according to FIG. 2.

In departure from the circuit arrangement according to FIG. 2 the junction point 159 of the resistors 153, 155 is connected with the non-inverting input + of the differential amplifier 147. To the terminal of the control switch 39 remote from ground and connected with the emitter of the switch transistor 137 there is connected a capacitor 161 which is connected through a resistor 165 together with the resistor 153 to a circuit point C conducting operating voltage potential. In parallel with the series connection of the capacitor 161 and the resistor 165 there is connected a discharge resistor 167. The connection point of the capacitor 161 with the charging resistor 165 is connected with the inverting input − of the differential amplifier 147.

This circuit arrangement works as follows:

With the control switch 139 normally opened the capacitor 161 discharges through the resistors 165 and 167. The switch transistor 137 is blocked, since the base lies at operating voltage potential when the control switch 139 is opened. When the capacitor 161 is discharged the base of the switch transistor 137 lies at operating voltage potential. The reference voltage amounts to about two-thirds of the operating voltage.

If the control switch 139 is closed the emitter of the switch transistor 137 is connected with ground and the switch transistor is switched through, i.e. is conducting. The capacitor 161 is charged up through the resistor 165 with a time constant determined by the resistor 165 and the capacitance of the capacitor. This time constant is shorter than the discharge time constant in accordance with the resistors 165 and 167. When the capacitor voltage reaches the reference voltage, the base of the switch transistor 137 is switched to ground potential and the energising current of the relay 135 is switched off.

Figure 5:
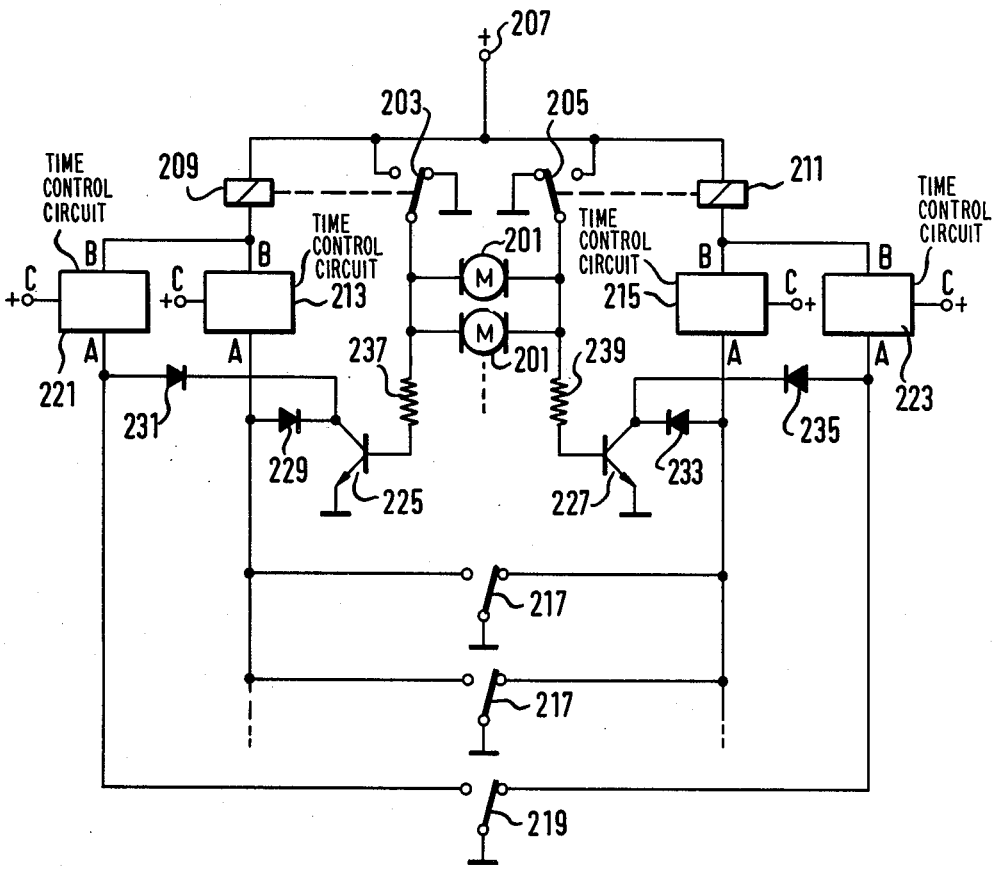
FIG. 5 shows a partial diagrammatic circuit diagram of a central locking system which can be switched on in two drive directions.

FIG. 5 shows further details of a central locking system the locking drives of which are driven by electric motors 201 of reversible rotation direction. The motors 201 are connected parallel with one another to a pole-reversing circuit formed from two relay switch-over contacts 203, 205 which connects the motors 201 with reversible polarity between an operating voltage terminal 207 and ground. The relay switch-over contacts 203, 205 pertain to separate relays 209 and 211 respectively. The energising currents of the relays 209 are controlled by separate time control circuits 213 and 215 respectively. Embodiments according to FIGS. 2 and 4 can be used for preference as time control circuits, and these circuits are to be connected to the circuit points A and B entered in FIGS. 2 and 4. C in each case designates the operating voltage terminal. Control changeover switches 217 which alternately trigger either the time control circuit 213 or the time control circuit 215 are connected parallel with one another to the circuit points A. The switch-over contacts 217 are on the one hand manually actuatable and are on the other hand positively controlled by the associated locking drives. If one of the switch-over contacts 217 is moved manually either into the locking position or into the unlocking position, the other parallel-connected switch-over contacts 217 are positively caused to follow by the locking drives.

The control changeover switches 217 can be provided for example in the front doors of the motor vehicle, so that on manual unlocking or locking of the door lock the locking drives of the other doors and of the boot and the like are also switched on therewith. In the example of embodiment according to FIG. 5 an additional control changeover switch 219 is provided on the boot lock, so that the central locking system can also be controlled by way of the boot lock. Ordinarily two sets of keys are provided of which the one set of keys locks all locks, while the other set of keys can lock only the doors and the ignition lock, but not the boot. In this embodiment the boot lock can be locked with the first key, so that the boot cannot be opened in a workshop or parking garage where the second key is supplied. In such an embodiment operating situations can arise where the control switches 217 are brought by means of the second key into a switch position differing from the control switch 219. In such an operating situation the central locking system could not be actuated from the boot lock by means of the first key. In order to deal with even this operating situation, the control changeover switch 219 is connected to separate time control circuits 221, 223 the switch-outputs B of which are connected in parallel with the switch-outputs B of the time control circuits 213 and 215. The time control circuits 221, 223 can again be time control circuits in accordance with FIGS. 2 and 4.

FIG. 5 shows a further detail which can also be utilised in other central locking systems where the locking drives are driven by current pulses of predetermined duration. The collector-emitter path of a switch transistor 225 and 227 is connected through decoupling diodes 229, 231 and 233, 235 respectively in parallel with the switch contacts of the control changeover switches 217, 219. The emitter of the switch transistors 225, 227, like the switch-over contact of the control changeover switches 217, 219, is connected to ground, while the collector in each case is connected through the diodes 229, 231 and 233, 235 respectively to the fixed contacts of the control changeover switches 217, 219. The diodes 229 to 235 are polarised in the forward direction for the collector current of the switch transistors 225, 227. The base of each of the switch transistors 225, 227 is connected through a base series resistor 237 and 239 respectively to that side of the pole-reversing circuit formed by the relay switch-over contacts 203, 205, which switches the switch transistor 225 or 227 through, in the closed switch position of the control changeover switch 217 and 219 respectively. The switch transistors 225, 227 form electronic short-circuit switches which are connected in parallel with the contacts of the control changeover switches 217, 219 and additionally short-circuit the control changeover switches 217, 219 for the duration of the drive pulse of the motors 201. The additional short-circuit renders the time control circuit 213, 215, 221 and 223 independent of any voltage drops in the supply leads of the control changeover switches 217, 219. Furthermore control changeover switches 217 having a middle rest position can be utilised which are merely briefly closed in the manual actuation of the control changeover switches. When such control changeover switches are used the switch transistors 225, 227 form holding circuits which hold the briefly occurring control signal of the control changeover switch for the duration of the drive pulse. The switch transistors 225, 227 do not have to be connected to the pole-reversing circuit; the base control signals can also be derived from other circuit points with two switch levels corresponding to the switch positions of the control changeover switches.

Figure 6:
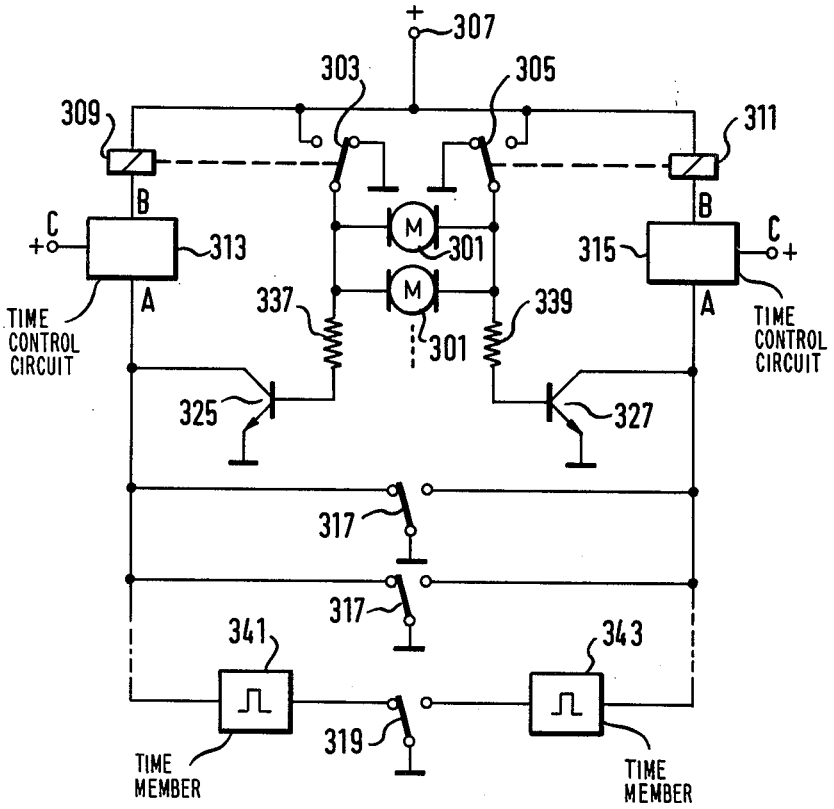
FIG. 6 shows another embodiment of a central locking system which can be switched on in two drive directions.

FIG. 6 shows another embodiment of a central locking system in which two sets of keys are available of which the first key locks all locks while the second key can lock the locks except for the boot lock. In the circuit arrangement according to FIG. 6 the following elements are comparable as regards their manner of operation and their circuit arrangement with elements according to FIG. 5, and reference numerals are stated increased by the numter 100 in relation to the reference numerals in FIG. 5 to characterize those in FIG. 6. For the explanation of these elements reference is made to the example of embodiment according to FIG. 5. The motors 301, the relay changeover switches 303, 305, the operating voltage terminal 307, the relays 309, 311, the time control circuits 313, 315, the control changeover switches 317, 319, the switch transistors 325, 327 and their base series resistors 337 and 339 are comparable. The collectors of the switch transistors 325, 327 are connected directly to the circuit point A of the time control circuits 313, 315, since only control switches of a time control circuit arrangement are to be short-circuited.

In place of the additional time control circuits 221 and 223 in FIG. 5, time members 341, 343 are provided which are triggered by the control changeover switch 319 of the boot lock and then deliver a tripping pulse to the control input A of the associated time control circuit 313 or 315. The pulse of the time members 341 or 343 simulates the brief closure of the control changeover switches 317 and triggers the time control circuit. The duration of the pulse of the time member 341, 343 is not important, since the holding circuits formed by the switch transistors 325, 327 take over the closing function of the control changeover switches.

Figure 7:
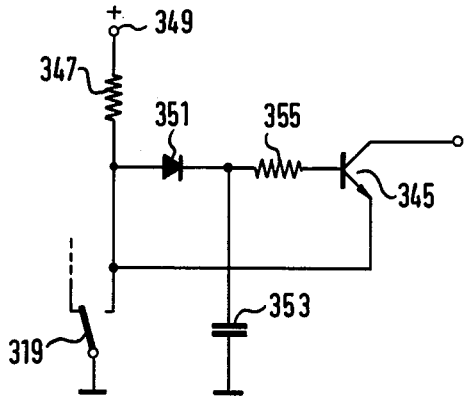
FIG. 7 shows a circuit diagram of a time member usable in the circuit arrangement according to FIG. 6.

FIG. 7 shows the circuit diagram of a preferred embodiment of the time members 341 and 343. The control switch 319 is connected to the emitter of a switch transistor 345, the collector of which is to be connected with the circuit point A of the time control circuits 313 and 315. The contact of the control changeover switch 319 remote from ground and thus the emitter of the switch transistor 345 are connected through a resistor 347 with an operating voltage terminal 349. A capacitor 353 is connected furthermore to the resistor 347 through a diode 351 polarised in the forward direction. The terminal of the capacitor 335 remote from the diode 351 is connected with ground. The junction point of the diode 351 and of the capacitor 353 is connected through a base series resistor 355 with the base of the switch transistor 345. When the control changeover switch 319 is in the opened position as illustrated in FIG. 7 the capacitor 353 is charged up through the resistor 347 and the diode 351 to the operating voltage. At the same time the base and the emitter of the thus opened switch transistor 345 lie at operating voltage potential. On closing of the control changeover switch 319 the emitter of the switch transistor 345 is connected to ground and thus switched through until the capacitor 353 is discharged through the base series resistor 355 and the base-emitter path of the switch transistor 345, whereupon the switch transistor 345 opens again.

Figure 8:
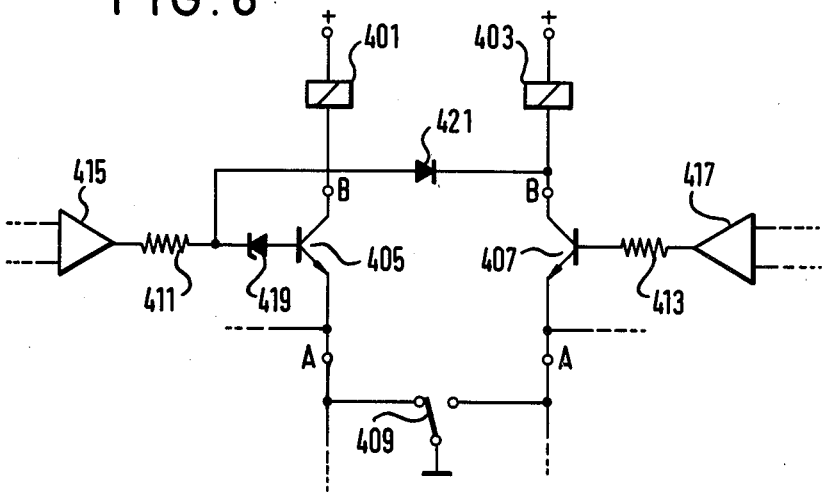
FIG. 8 shows an additional circuit arrangement, usable in combination with the circuit arrangements according to FIGS. 5 and 6, for ensuring a preferred direction of drive.

FIG. 8 shows a further improvement which is advantageous in the central locking systems according to FIGS. 5 and 6. If one of the control switches is switched only briefly into one direction and then switched back again into the initial position, before the time control actions thus instigated have elapsed, under some circumstances operating faults can occur. These faults can be avoided if the time control stages for at least one switching direction are connected for negative feedback, so that the time control circuit of the opposite direction is positively switched off. FIG. 8 shows an example of embodiment of such a negative feedback connection. 401 and 403 designate the relays of the pole-reversing circuit which are in each case connected in series with the collector-emitter path of a switch transistor 405 and 407 respectively of the time control circuit for connection to the circuit points A and B. As already explained above, the fixed contacts of a control changeover switch 409 leading to ground are connected to the emitters of the switch transistors 405, 407. As was explained with reference to FIGS. 2 and 4, the base of each switch transistor 405, 407 is connected through a base series resistor 411, 413 in each case with the output of a differential amplifier 415 and 417 respectively. Details of the manner of operation of this circuit arrangement are described in connection with FIGS. 2 and 4.

In the circuit arrangement as illustrated the relay 401 controls the unlocking movement, while the relay 403 switches on the locking drives for the locking operation. The base of the switch transistor 405 controlling the unlocking operation is connected through a Zener diode 419 polarised in the blocking direction to the base series resistor 411. The Zener diode 419 ensures a constant voltage drop in the base current path. Its terminal remote from the base is coupled through a diode 421 to the collector of the switch transistor 407. The diode 421 is polarised in the forward direction for the base current of the switch transistor 405 and controls the switch condition of the switch transistor 405 in dependence upon the switch condition of the switch transistor 407.

If the control switch 409 is switched over out of the position as illustrated in FIG. 8, switching on the locking drive systems in the unlocking direction, into its other position the switch transistor 407 is switched through and connects the cathode of the diode 421 with ground potential. The diode 421 short-circuits the control signal of the differential amplifier 415, which holds the switch transistor 405 switched through, to ground whereby the switch transistor 405 opens and the relay 401 is de-energised.

While specific embodiments of the invention have been shown and described in detail to illustrate the application of the inventive principles, it will be understood that the invention may be embodied otherwise without departing from such principles.

What is claimed is:

1. Central locking system comprising:

a plurality of electric locking drives (1; 31; 131; 201; 301), a time control circuit means (11) triggerable by at least one control switch (13; 39; 139; 217, 219; 317, 319; 409) in switching over from a first switch position into a second switch position, said circuit means switching said locking drives on for a predetermined time duration in a predetermined drive direction, a switch signal generating means (23; 63, 65; 167) controlled by said control switch for generating a first two-level control signal the control levels of which represent said switch positions of said control switch, a ramp signal generator means (15; 61, 67; 161, 165) generating a ramp signal varying in time from a predetermined initial level with constant direction and being triggered by said switch signal generating means in switching over said control switch from said first switch position into said second switch position, a comparator means (21; 47; 147) comparing the level of said ramp signal with a constant level of a reference signal and generating a second two-level control signal the control level of which represents the sign of the level difference between said ramp signal and said reference signal, and a control means (25; 37; 137; 405, 407) switching on said locking drives in said predetermined drive direction as long as said first control signal occurs with a control level representing said second switch position of said control switch and at the same time said second control signal occurs with a control level resulting for said predetermined initial level of said ramp signal and furthermore switches off said locking drives for said predetermined drive direction.

2. Central locking system according to claim 1, characterized in that said comparator means (21; 47; 147) comprises a differential amplifier having a first input coupled to said ramp signal generating means (15; 61, 67; 161, 165), a second input coupled to a reference voltage source (17; 53, 55; 153, 155) and its output coupled to said control means (25; 37; 137).

3. Central locking system according to claim 1 or 2, characterized in that said control means comprises a switch transistor (37; 137) having a base and a collector-emitter path and controlling said locking drives, the base being connected to an output of said comparator means (47; 147) providing said second control signal and said collector-emitter path being connected in series with said control switch (39; 139).

4. Central locking system according to claim 3, characterized in that said control switch (39; 139) is connected between ground and an emitter of said switch transistor (37; 137) and in that said emitter is connected through a resistor (65; 167) with a circuit point which conducts a potential blocking said switch transistor (37; 137) when said control switch (39; 139) is openend.

5. Central locking system according to claim 1, characterized in that said locking drives (201; 301) are operable in two opposite drive directions and connected in parallel to a pole-reversing circuit (203, 205; 303, 305) controlled by relays (209, 211; 309, 311), in that for each drive direction at least one separate time control circuit (213, 221 and 215, 223; 313 and 315) is provided and in that said at least one control switch is formed as control changeover switch (217, 219; 317, 319) which triggers the time control circuits alternately.

6. Central locking system according to claims 3 or 5, characterized in that the base of said switch transistor (405) switching on the locking drives in the unlocking direction is coupled through a first diode (421) with the collector of said switch transistor (407) switching on the locking drives in the locking direction (FIG. 8).

7. Central locking system according to claim 6, characterized in that said first diode (421) is coupled through a second diode (419), preferably a Zener diode, connected between said comparator means (415) and the base of said switch transistor (404) switching on the locking drives in the unlocking direction, with the base of this switch transistor (405).

8. Central locking system according to claim 5, characterized in that a plurality of said changeover switches (217, 219) switchable positively each by one of said locking drives (201) are provided and at least one of the locks which can be locked by said locking drives is lockable independently of its locking drive and in that the control changeover switch (219) of this lock triggers at least one additional time control circuit (221, 223) which switches on said locking drives (201) (FIG. 5).

9. Central locking system according to claim 5, characterized in that a plurality of control changeover switches (317, 319) switchable positively each by one of said locking drives (301) are provided and at least one of the locks which can be locked by said locking drives (301) is lockable independently of its locking drive and in that the control changeover switch (319) of the locking drive of this lock is connected to at least one time member (341, 343) which on switching over of the control changeover switch (319) delivers a pulse triggering said time control circuit (313, 315) (FIG. 6).

10. Central locking system according to claim 9, characterized in that each time control circuit (313, 315) controls a holding circuit (325; 327) which short-circuits said changeover switch or switches (317, 319) for the predetermined time duration of switching on of said locking drives (301).

11. Central locking system according to claim 9, characterized in that said time member (341, 343) comprises a switch transistor (345) having a collector-emitter path connected in series with said control changeover switch (319) of said lock which can be locked independently of its locking drive, and in that said switch transistor (345) having a base connected with a capacitor (353) which is connected, through a diode (351) polarised in the forward direction and a resistor (347) on the side of the diode (351) remote from said capacitor, with an operating voltage terminal (349), and in that this control changeover switch (319) is furthermore connected in parallel with said capacitor (353), in series with said diode (351) (FIG. 7).

12. Central locking system according to claim 5, characterized in that said relays and said time control circuits are connected through separate diodes (41, 49) polarised in the forward direction, to an operating voltage terminal.

13. Central locking system according to claim 1, characterized in that said ramp signal generator means comprises a first circuit (63, 65; 165, 167) connected to a capacitor (61; 161) permitting current to flow in a first current direction through said capacitor irrespective of the switch position of said control switch (39; 139), and in that said control switch is connected to a second circuit (67; 165) which in one of said switch positions of said control switch permits current to flow through said capacitor in a second current direction opposite to said first current direction.

14. Central locking system according to claim 13, characterized in that said capacitor (61) is connected with one terminal to ground and with its other terminal through a diode (63) polarised in the forward direction, by way of a charging resistor (65) provided on the side of said diode (63) remote from said capacitor, to an operating voltage terminal (43), in that a discharging resistor (67) is connected in parallel with said capacitor (61) and in that said control switch (39) is connected in parallel with said capacitor (61) in series with said diode (63).

15. Central locking system according to claim 14, characterized in that said comparator means comprises a differential amplifier (47) having a non-inverting input connected to said capacitor (63) and an inverting input connected to a reference voltage source (53, 55) connected to said operating voltage terminal (43).

16. Central locking system according to claim 15, characterized in that said reference voltage source (53, 55) delivers a reference voltage which is equal to approximately one-third of the operating voltage.

17. Central locking system according to claim 13, characterized in that said capacitor (161) is connected with one terminal through said control switch (139) to ground and with its other terminal through a charging resistor (165) to an operating voltage terminal (C) and in that a discharge resistor (167) is connected in parallel with the series connection of said charge resistor (165) and said capacitor (161).

18. Central locking system according to claim 17, characterized in that said comparator means is formed as differential amplifier (147) having an inverting input connected to said capacitor (161) and a non-inverting input connected to a reference voltage source (153, 155) connected with the operating voltage terminal (C).

19. Central locking system according to claim 18, characterized in that said reference voltage source (153, 155) delivers a reference voltage which is equal to about twothirds of the operating voltage.

20. Central locking system according to claim 1, characterized in that said control switch (217, 219; 317, 319) is closed in a second switch position and in that a switch transistor (225, 227; 325, 327) having a collector-emitter path connected in parallel with said control switch (217, 219; 317, 319) is controlled by said time control circuit means (213, 215, 223, 225; 313, 315) for short-circuiting said control switch (217, 219; 317, 319) during said predetermined time duration in which said locking drives (201; 301) are switched on.

21. Central locking system according to claim 20, characterized by a pole-reversing circuit (203, 205; 303, 305) for reversing the drive direction of said locking drives (201; 301) controlled by said time-control stage (213, 215, 223, 225; 313, 315) and by said switch transistor (225, 227; 325, 327) having its base coupled to said pole-reversing circuit.

22. Central locking system comprising: a plurality of electric locking drives (1; 31; 131; 201; 301), a time control circuit means (11) triggerable by at least one control switch (13; 39; 139; 217, 219; 317; 319; 409) in switching over from a first switch position into a second switch position, said circuit means switching said locking drives on for a predetermined time duration in a predetermined drive direction, characterized in that said control switch (217, 219; 317, 319) is closed in the second switch position and in that a switch transistor (225, 227; 325, 327) having a collector-emitter path connected in parallel with said control switch (217, 219; 317, 319) is controlled by said time control circuit means (213, 215, 223, 225; 313, 315) for short-circuiting said control switch (217, 219; 317, 319) during said predetermined time duration in which said locking drives (201; 301) are switched on.

23. Central locking system according to claim 22, characterized by a pole-reversing circuit (203, 205; 303, 305) for reversing the drive direction of said locking drives (201; 301) controlled by said time-control stage (213, 215, 223, 225; 313, 315) and by said switch transistor (225, 227; 325, 327) having its base coupled to said pole-reversing circuit.

* * * * *